US010988279B2

(12) United States Patent
Slocum et al.

(10) Patent No.: US 10,988,279 B2
(45) Date of Patent: Apr. 27, 2021

(54) PACKAGE MAKER

(71) Applicants: Alexander Slocum, Bow, NH (US); Debra Thurston-Slocum, Bow, NH (US)

(72) Inventors: Alexander Slocum, Bow, NH (US); Debra Thurston-Slocum, Bow, NH (US)

( * ) Notice: Subject to any disclaimer, the term of this patent is extended or adjusted under 35 U.S.C. 154(b) by 0 days.

(21) Appl. No.: 16/631,952

(22) PCT Filed: Oct. 11, 2019

(86) PCT No.: PCT/US2019/055762
§ 371 (c)(1),
(2) Date: Jan. 17, 2020

(87) PCT Pub. No.: WO2020/077167
PCT Pub. Date: Apr. 16, 2020

(65) Prior Publication Data

US 2020/0399012 A1 Dec. 24, 2020

Related U.S. Application Data

(60) Provisional application No. 62/745,347, filed on Oct. 13, 2018.

(51) Int. Cl.
*B65D 3/00* (2006.01)
*B65D 3/20* (2006.01)
*B31C 3/04* (2006.01)

(52) U.S. Cl.
CPC . *B65D 3/20* (2013.01); *B31C 3/04* (2013.01)

(58) Field of Classification Search
CPC .. B31C 3/00; B31C 3/04; B65B 43/08; B65B 43/10; B65D 3/00; B65D 3/02; B65D 3/10; B65D 3/20
See application file for complete search history.

(56) References Cited

U.S. PATENT DOCUMENTS 3,732,790 A * 5/1973 Miyake ..... B31B 70/00 493/278
2003/0087051 A1 5/2003 Murray
(Continued)

FOREIGN PATENT DOCUMENTS

GB 2008078 5/1979
GB 2008078 A * 5/1979 ..... B65D 5/02
GB 2546754 8/2017

*Primary Examiner* — Chelsea E Stinson
(74) *Attorney, Agent, or Firm* — Occhiuti & Rohlicek LLP

(57) ABSTRACT

An apparatus for forming a box or bag that is made of a substrate strip which includes a winder having a mandrel and posts that extend from the mandrel in a direction parallel to a winding and translation axis that rotate together as a unit around the translation axis. The apparatus also has a feeder that includes precursors and a gathering head used for forming the precursors into the strip and feeding the strip to the winder. A motor adjusts the feeder's angle relative to the winder in response to instructions from the controller based on the dimensions of the box or bag. This causes controlled overlap between adjacent windings of the strip on the posts. As the mandrel rotates, the posts draw the strip and wind the strip along a spiral having a length in excess of the depth. Zero waste of precursors is made possible by cutting the substrate perpendicular to its length and folding over the box or bag ends to form an angled seam with respect to the sides of the box.

30 Claims, 10 Drawing Sheets

(56) References Cited

U.S. PATENT DOCUMENTS

| | | | | |
|---|---|---|---|---|
| 2004/0136619 | A1 | 7/2004 | Spork et al. | |
| 2008/0060747 | A1 | 3/2008 | Lee et al. | |
| 2019/0061298 | A1* | 2/2019 | Sager | B32B 3/266 |
| 2019/0061989 | A1* | 2/2019 | Sager | B32B 29/005 |

* cited by examiner

| Square Box Calculations | Variable | Value | Unit | Formula |
|---|---|---|---|---|
| Strip width | w | 4 | length | input value |
| Number of wrap segments | Nseg | 25 | | |
| Box inside approximate dimensions | | | | input value |
| Footprint (L x L) square) | L | 12 | length | input value |
| Approx. depth | Dpth | 13.1 | | input value |
| Bend radius | rb | 0.25 | length | input value |
| perimeter | P | *52.283* | length | 4*(L-2*rb+2*PI()*rb) |
| Strip wrap pitch angle | thetar | *0.077* | radians | ASIN(w/P) |
| (Pitch angle in degrees) | thetad | 4.388 | degrees | 180*thetar/PI() |
| Effective vertical strip width | wp | 4.012 | length | w/COS(thetar) |
| Third corner height | h3c | 1.003 | length | wp/4 |
| Additional distance to wp needed to for closing flaps | dd | 3.618 | length | (L+rb-wp-h3c)/2 |
| Distance from first corner tip to bottom of closing flap slit | Lbs | 7.629 | length | dd+wp |

FIG. 17

PACKAGE MAKER

RELATED APPLICATIONS

This application is a national phase under 35 USC 371 of international Application No. PCT/US2019/055762 filed Oct. 11, 2019 which claims the benefit of the Oct. 13, 2018 priority date of U.S. Provisional Application 62/745,347 the contents of which are herein incorporated by reference.

BACKGROUND

Packages are widely used for shipping goods. To enable more efficient use of resources, the package should be no larger than necessary to safely accommodate the goods to be shipped. Since goods come in many sizes, it is useful to also have packages that come in many sizes.

A typical package used to hold or ship product is a cardboard box or a padded bag. To make a box, a commercially available custom box size making machine begins by taking cardboard from a Z-fold stack. It then makes appropriate cuts in the cardboard and either also folds it to make the box or presents the cut flat cardboard to then be folded into a box by a person or other machine. Such machines are quite large, particularly because of the need to accommodate the stacks of Z-folded cardboard and feeding mechanisms. Additionally, the cutting process results in wasted cardboard.

The cardboard that forms the raw material for such a machine is made on a large machine that outputs a continuous sheet of cardboard that is then periodically creased on opposite sides that allows it to form a Z-fold stack. The stack has a large footprint since cardboard is mostly air, and thus the stack takes up a significant portion of the floorspace allocated to a custom box making operation. As cardboard's surface area to volume ratio is low, the stack must be often replenished.

Padded mailing bags are also made using large expensive machines that make one size of bag from rolls of material (converter machines). Very large quantities of the same size bag can be made, but significant set-up time is required to change the size of the bag made. Hence padded bags are made and stacked into a box for shipment and then the padded bags, which themselves take up a large volume because they are also mostly air, must frequently be replenished at packing stations that use padded bags to pack and ship goods.

SUMMARY

The present invention provides a way to create box or bag packages having customized dimensions with minimal or zero waste of material by using an innovative machine that does not require a large space for holding the material that is used to make the package.

In one aspect, the invention features an apparatus that forms a package from roll-based materials. For example, in one embodiment, the apparatus produces cardboard boxes. Yet, it does so without actually having to be provided with cardboard, but rather just paper sheet on rolls that is formed into cardboard as a first step in the machine, and then wound on an adjustable mandrel to form the desired size box. One roll provides paper for the outer layer of the cardboard, one roll provides paper to be corrugated and for the center region, and one roll provides paper for the inner layer.

In another embodiment, the apparatus produces padded (cushion-lined) bags, again from just flat sheet material on rolls that is formed into the outer skin of the bag with an internal cushion layer. The outer layer can be paper and the cushion layer can be corrugated. Alternatively, the outer layer can be plastic (or paper) and the inner layer bubble wrap made from flat bubble wrap material on a roll that is inflated, sealed and combined with the outer layer material.

The apparatus thus does not require the actual substrate that is used to make the package. Instead, it accepts substrate precursors. The apparatus converts the substrate precursors into a "substrate strip" herein referred to just as the "substrate" or the "strip." For a brief interval after having been thrilled, the strip remains flexible. Before the adhesive that bonds the sheets together to form the strip has time to become fully solidified, it is helically (spiral) wound around a rotating adjustable size mandrel to form a tube of any desired cross section and length (depth of container). The size and shape of the mandrel define the cross section of the package, such as a rectangular (including square) box when the mandrel has four posts, a hexagon when the mandrel has two posts, or a bag when the mandrel has two posts. The length of the spiral defines the depth of the package and also provides the material to fold over to form the end flaps to close the package.

In a preferred embodiment, the mandrel's size is adjustable so that the cross section (footprint) of the package can be adjusted. Alternatively, the mandrel can be swapped out for another size mandrel having the desired cross section.

Among the embodiments with an adjustable mandrel are those in which the mandrel has N position-programmable corner posts around which the strip can be wound. When N equals four, this will produce a package having four sides. The lengths of the sides will depend on the distances between the corner posts. In other embodiments, there will be different numbers of corner posts to be used for packages that have different numbers of sides.

At the end of the winding process, when the package has reached the correct depth, the strip that has been fed onto the mandrel is cut to free the wound structure. The ends of the wound package structure will ultimately be folded inwards to tbnn the package's top and bottom, and just creases can be used, or slits along the wound structure's end corners to a desired depth can be made to enable easier inward folding to form flaps that can be used to close the box.

Since the package is formed from winding a strip around a mandrel, the end result is a rectangular helix that extends along an axis. This axis is normal to a transverse plane. Meanwhile, the edges at each end of the rectangular helix define proximal and distal end planes. These end planes and the transverse plane are not parallel. However, by choosing an extent to which these planes are not parallel, it is possible to reduce and virtually eliminate waste associated with trimming to form end flaps. Contrast this to a conventional box where the end flaps that are used to close the box are open, their edges define end planes that are parallel to the transverse plane.

In some embodiments, the apparatus includes a feeder on which are mounted rolls of substrate precursors and a converter that converts the precursors into the substrate from which the package is made. One embodiment features three spools loaded with of paper to form first, second, and third layers of cardboard. The paper from the first roll forms the outer layer (skin) of the cardboard. This is the layer that is exposed to the environment. The paper from the third roller forms the inner liner layer of the cardboard. This is the layer that faces the goods being shipped. The paper from the second roll passes through a tlute maker and ultimately forms the fluting (corrugation) layer that separates the inner and outer layers and provides strength to the box's sides.

In some embodiments, adhesive applicators apply adhesive to the underside of the first layer and the top side of the third layer. All three layers' adhesive joints are fresh and hence compliant during the process of being wrapped around the corner posts during the winding process, but fully cure soon thereafter in time for the box to be loaded with goods to be shipped.

During the winding process, there will exist an angle between the mandrel's axis of rotation and the line that the three layers traverse on their way to the mandrel. This angle, which will be referred to herein as a "wrap angle," governs the pitch of the winding. It is therefore useful for the feeder angle to be computer controlled to be able to rotate (yaw) with respect to the rotation axis of the mandrel so as to adjust this wrap angle to the desired position.

To carry out the winding process, it is useful to have relative motion between the feeder and the mandrel along the mandrel's rotation axis. Accordingly, some embodiments feature a conveyor to axially move the package towards an end of the mandrel as the spiral winding process forms the package. Other embodiments have the feeder move along a linear axis parallel to the mandrel's winding axis.

Embodiments further include those that add folding features (scores, creases, slits on end panels) to the ends of the package as it moves along the mandrel or as the completed package leaves the mandrel. These folding features enable the ends of the package to be folded over so that the package can be closed. Examples of such folding features include slits or scores. These can be formed mechanically or with a laser. Other examples include a creased set of facets in which one or more creases are disposed to guide the folding process.

In the preferred embodiment, the ends of the substrate (its precursors) are simply cut square (perpendicular to its length) so as to leave what will become, when the end flaps are folded down to close the box, a small overlapping triangle at the ends of the helically wound structure that can become part of the end-flap fold and this totally eliminates waste so the machine does not have to deal with waste. What would have been waste instead becomes part of the box, thus increasing its strength and packing resilience. This greatly simplifies the machine's design, as no mechanism for angled cuts or dealing with waste is needed. However, it does require a special angled end fold, which at first thought would seem not possible. Nevertheless, as shown herein, such a fold is indeed possible. Moreover, such a fold leads to a unique and interesting box end that is also very structurally sound.

Embodiments also include those in which there more than three precursors and those in which there are fewer than three precursors for making the substrate just prior to the winding process. For example, some embodiments feature only two rolls of paper with paper from the first roll providing an outer layer and the paper from the second roll passing through a flute maker to form a fluted inner layer which can be of a common undulating (sinusoidal like) or honeycomb type structure. "Honeycomber" devices in the paper industry convert paper to a honeycomb structure for laminating between flat sheets to form an alternative form of cardboard which is then cut into desired flat shapes. In these embodiments, an adhesive applicator applies adhesive to an underside of the outer layer. The two layers then join to each other to form a substrate strip while being wound on the mandrel. This can be used to form a light duty box, or the resulting structure is one that is easily pressed flat to form a bag.

Although a substrate derived from paper is ubiquitous, there also exist substrates made of plastic film, or bubble wrap. Other examples include adhesive tape, such as gaffer's tape. In such cases, the adhesive applicator can be dispensed with. When just two layers are used, such as forming a bubble wrap lined bag, the precursor materials can also be coated on one side with contact adhesive (contact cement) which only adheres to itself on contact. This further greatly simplifies the machine design because it eliminates the need for an adhesive applicator. Furthermore, if plastic substrate materials are used (e.g., PE film), heat bonding and sealing can be used totally eliminating the need for adhesives. Eliminating adhesives and just having "pure" plastic also greatly increases the recyclability of the bags.

In some embodiments, the apparatus is a computer-controlled package forming machine that controls the positions of the corner posts and the relative axial movement between the mandrel and the strip that is being fed by the feeder.

BRIEF DESCRIPTION OF THE DRAWINGS

FIG. 13 shows the second and sixth panels of the package in FIG. 11 with score lines and dark regions showing the triangles that would lay flat when the sides are folded in;

FIG. 14 shows the fourth and seventh panels of the package in FIG. 11 with score lines and dark regions showing the quadrilaterals panels bordering top and bottom edges that would lay flat when the sides are folded in;

FIG. 17 shows cells from a spreadsheet and the formulas for helping to design the box and control its manufacture in the package maker machine.

DETAILED DESCRIPTION

Figure 1:
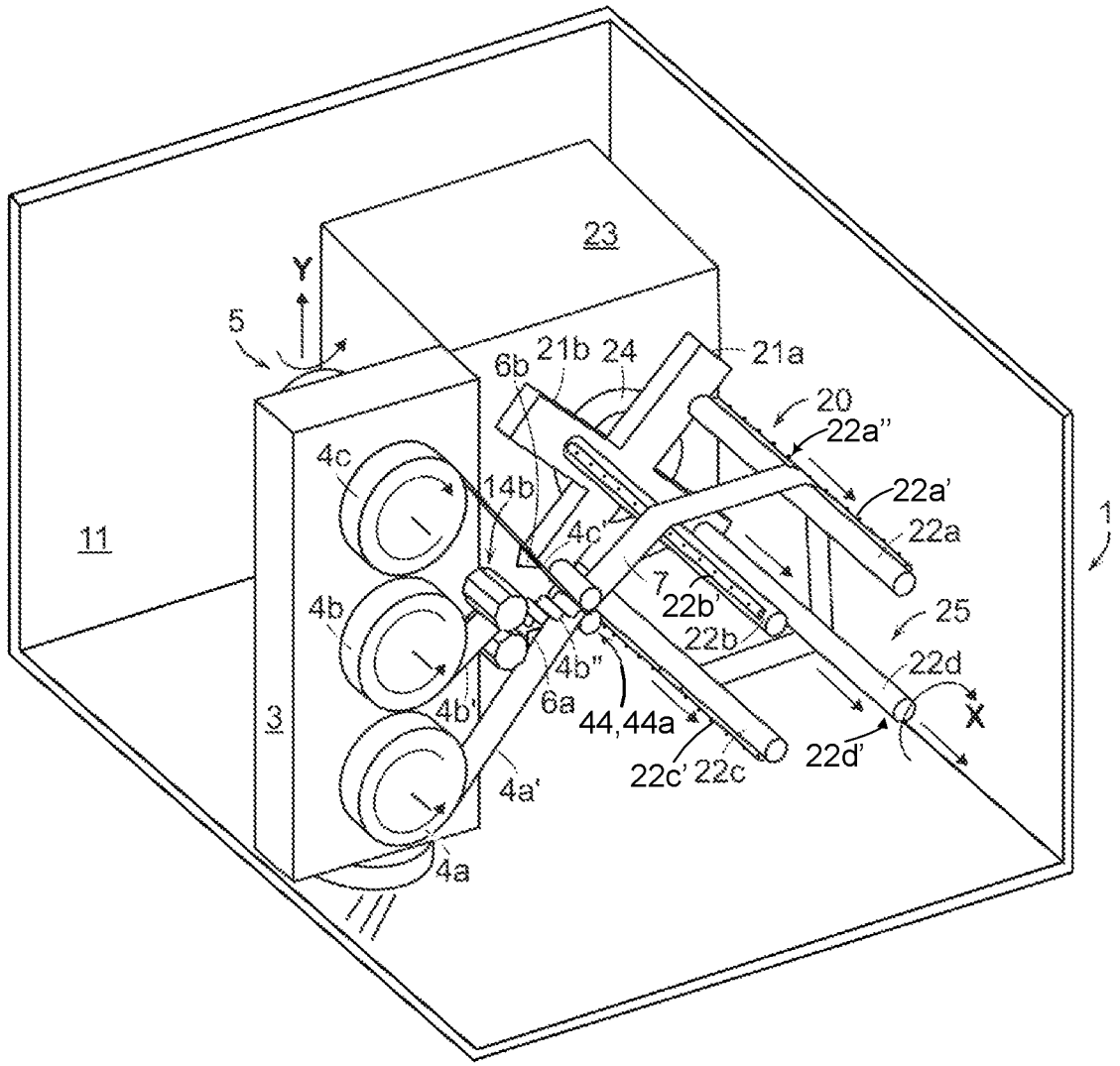
FIG. 1 is an isometric view of a package-forming machine.

FIG. 1 shows a package-forming machine 1 for making packages out of a substrate. A typical package is a polyhedron that has been translated along an axis to form a "prism" (not limited here to a classic prism as thought of in optics, but rather as an N dimensional package). This axis will be referred to herein as the "translation axis."

In the discussion that follows, the polyhedron is a rectangle having a length and a width with the length exceeding the width. This defines a short side and a long side of the package. The extent to which the rectangle is translated to form the "prism" will be referred to as the package's "depth." Although boxes for shipping are often made of cardboard, the term "box" as used herein is not limited by the material from which it has been made.

For convenience, it is useful to define a coordinate system in which the x-axis extends along the translation axis. The y-axis extends orthogonally from the x-axis in an upward direction as shown in the figure. These can both be seen in FIG. 1. A z-axis, which is not shown, extends in a direction appropriate to form a right-handed coordinate system. The direction along the x-axis will be referred to as "axial directions." Directions parallel to the y-axis will be referred to as "vertical."

The package-forming machine 1 includes a supporting structure 11 that supports a mandrel 20 having a mandrel axis 24 and a mandrel head 23. A drive, which would be located inside the mandrel head 23, rotates the mandrel 20 about the axial direction.

The mandrel head 23 has a rotating spindle 24 that holds four angularly position controlled arms 21*a*, 21*b*, 21*c*, 21*d* that are perpendicular to the mandrel longitudinal axis X. Only first and second arms 21*a*, 21*b* are visible in the figure.

Extending from each arm 21*a*, 21*b*, 21*c*, 21*d* is a corresponding first, second, third, and fourth corner post 22*a*, 22*b*, 22*c*, 22*d*, each of which are linear position controllable along the lengths of the respective arms to which they are attached. A rectangle defined by these corner posts 22*a*, 22*b*, 22*c*, 22*d* thus defines a footprint of the resulting package. The first post 22*a* and the second post 22*b* are separated by a first distance. This same first distance separates the third post 22*c* and the fourth post 22*d*. This first distance will be the length of a side of the package. Similarly, the first post 22*a* and the fourth post 22*d* are separated by a second length. This second length also separates the second post 22*b* from the third post 22*c*. The second distance will be the length of a second side of the package. By adjusting the relative angles of the arms 21*a*, 21*b*, 21*c*, 21*d* and the positions of the posts along the lengths of the arms, the shape of the rectangle that defines the cross section of the box can be defined. This is referred to as an R-Theta machine. If six arms and six posts are used, a hexagonal box could be wrapped. If just two arms, which would be fixed colinearly, and two position controllable posts are used, a bag could be formed. In some embodiments six arms can be provided and the posts can be removable so a single machine could be used to make bags or up three, four, five, or six sided boxes.

In operation, the mandrel head 23, the arms 21*a*, 21*b*, 21*c*, 21*d*, and the posts 22*a*, 22*b*, 22*c*, 22*d* rotate as a unit around the translation axis.

FIG. 1 shows the package-forming machine built as a modular system of subassemblies mounted to a frame 1 after having just begun to form a package using windings 7 formed from a "substrate" ("strip") that is formed at a gathering head 44. As is apparent, only a first winding 7 has been laid down around the posts 22*a*, 22*b*, 22*c*, 22*d*. Each revolution of the mandrel 10 draws a further length of the strip and uses it lay down another winding 7.

To form the box, especially where the depth of the box is larger than the width of the substrate, each winding must be displaced from the previous and thus it is required to provide movement in the axial direction. To achieve such axial movement, it is useful to provide conveyor mechanisms 22*a*'-d', such as a chains with sharp spiked protrusions 22*a*" (outward facing gripping protrusions) to grip the inner surface of the strip, that move along the posts 22*a*, 22*b*, 22*c*, 22*d* as indicated by the arrows in FIG. 1, thereby advancing the helix along the posts as the box is wound. Alternatively, there can be relative axial motion between the mandrel and the substrate forming apparatus, such as by mounting one on a linear motion mechanism which can be a modular purchased item that is readily interfaced to the system's computer controller and it is comprised of a linear motion bearing(s), actuator, and position feedback device that provides relative axial motion between the feeder and the winder, either of which could be mounted to it.

The package-forming machine 1 further includes a feeder 3 that carries out two functions: creating the substrate strip and then feeding the newly created strip towards the mandrel 10.

The feeder 3 creates the substrate strip using pre-cursor materials that are stored on first, second, and third pre-cursor material roll handlers 4*a*, 4*b*, 4*c* that hold rolls of precursor material and meter it out as needed, often using a servo motor to maintain tension. These sorts of roll handlers are commonly used in the field of converter machines. In the embodiment described herein, the precursor materials are paper that is used to make cardboard, such as Kraft paper. However, the principles described herein are useful for making similar composite materials, for example for making bubble wrap or paper sheets with bubble wrap integrated therewith.

Figure 2:
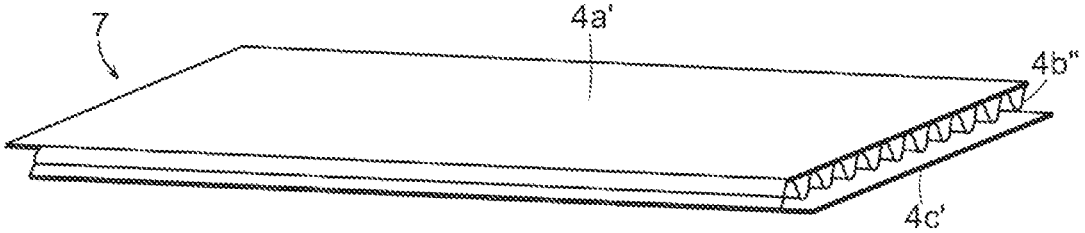
FIG. 2 is an isometric view of a three-layer substrate strip that has been formed by the package-forming machine of FIG. 1.
Figure 15:
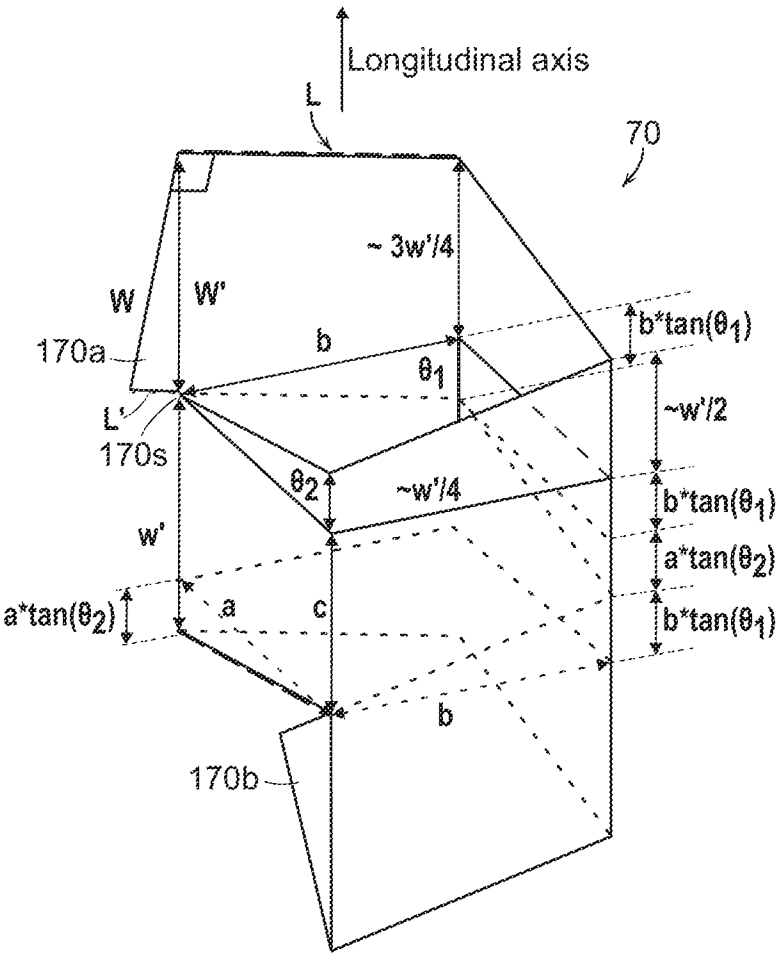
FIG. 15 shows the box of FIG. 11 where the very beginning and the very end of the material wound to form the box has been cut perpendicular to the length of material, and variables for dimensions of the box are provided.

First paper 4*a*' stored on the first roll 4*a* forms an inner layer of the strip. This is what that faces the goods being shipped. Second paper 4*b*' stored on the second roll 4*b* passes through a flute maker 14*b* to form a layer of fluting (corrugation) 4*b*". A typical flute maker 14*b* features a corrugated rolling machine or a corrugating machine that forms undulating shapes (sinusoidal like) or a honeycomb type structure on a material passing through it. It will thus be understood that herein "fluted" (and "fluting") is defined to mean a "corrugated" or "honeycomb-like" structure that can be formed from a flat sheet that can be adhered between two flat sheets to make a strong laminated board-like structure. This fluting 4*b*" forms the air space that separates the inner and outer layers of the strip and provides the means by which the inner and outer layers of paper act as together as a laminate where the fluting transmits shear stresses between them. Third paper 4*c*' stored on the third roll 4*x* forms an outer layer. This is the layer that is exposed to the environment. The two layers and the fluting 4*b*" come together at the gathering head 44 to form the "substrate" (or strip). As shown in FIG. 2, this substrate is a multi-layer structure. The gathering head 44 would, at its output, also contain a substrate cutter 44*a* that may cut the substrate's end perpendicular to the long axis of the material to ensure no waste (FIG. 15).

As the mandrel 10 rotates, the posts 22*a*, 22*b*, 22*c*, 22*d* take up the strip and form a winding 7 that wraps around the posts 22*a*, 22*b*, 22*c*, 22*d*. As it does so, the layers bond to each other. A robot or other similar mechanism (not shown) would place the end of the strip on a post at the beginning of the winding process: the end region of the inner layer of the strip would be pierced and held by the aforementioned spiked chain conveyer(s). It would thus be held so the helical winding process could begin.

At each revolution of the mandrel 10, the posts 22*a*, 22*b*, 22*c*, 22*d* draw another winding's worth of the strip from the gathering head 44 and form another winding 7' next to the preceding winding 7. Each revolution of the mandrel 10 thus lays down one winding 7 and extends the package along the translation axis by a fixed growth increment, although as the winding process occurs, the relative axial motion of the wound structure and the feeder is continually controlled. The value of the growth increment depends on the width of the strip, the extent to which strips overlap with each other, and a wrap angle at which the strip meets the mandrel 10. The feeder 3 rotates about a vertical yaw axis 5 so as to adjust this wrap angle. In some embodiments, a controller controls a motor, such as a stepper motor or a servo motor, that controls the wrap angle. For a non-square footprint box, this wrap angle will change between the short and long sides. The controller has been omitted from the figures for clarity. However, such controllers, which include computer numerical control systems, are well known in the art of automated machinery, and can simultaneously control many different motion axes.

Figure 3:
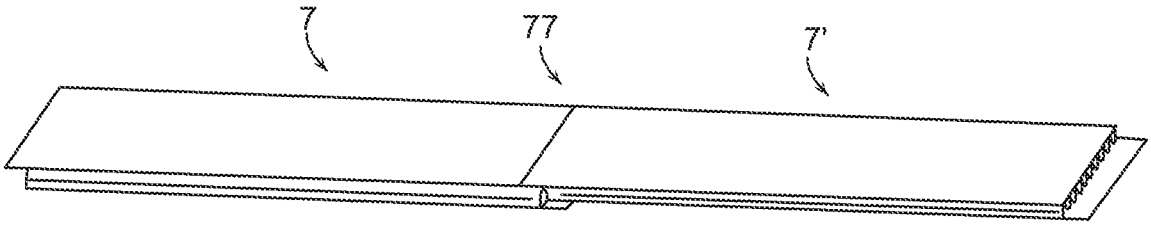
FIG. 3 is an isometric view of a section of two adjacent strips of the type shown in FIG. 2 that have been connected at a lap joint.

Upon completion of one revolution, the package will have extended along the translation axis by the width of one winding 7. To make the package extend further, the mandrel 10 begins a second revolution. This lays down a second winding 7'. The first and second windings 7, 7' are offset so that the second winding 7' is laid down adjacent to the first winding 7, as seen in FIG. 3. Thus, at the completion of the mandrel's second revolution, the package will have grown to extend along the axial direction by the width of two windings 7, 7'. This procedure continues, with each revolution of the mandrel 10 causing the package's length to grow by a fixed amount.

The depth of the package is thus controlled by the number of revolutions of the mandrel 10, the width of the strip, and the wrap angle. The length and width of the package are controlled by the positions of the corner posts 22*a*, 22*b*, 22*c*, 22*d*. These can be adjusted to make different size packages, either manually or, more conveniently, by using a computer-controlled stepper or servo motor to reposition them. This allows the apparatus to be conveniently modified to accommodate different packages. The corner posts 22*a*, 22*b*, 22*c*, 22*d* also include conveyors 22*a*', 22*b*', 22*c*', 22*d*', or linear-motion mechanisms that move the forming package towards the end of the mandrel 10 as it grows with each winding 7. As the package comes off the mandrel 10, a cutting device forms slits or scores to permit the ends of the package to function as flaps that fold over to close the ends. A suitable cutting device is a mechanical cutter, such as a rotating knife, or a laser.

In a preferred embodiment, the second roll 4*b* carries a strip of second paper 4*b*' that is narrower than either the strip of first paper 4*b*' or the strip of third paper 4*c*'. As a result, it is possible to construct a strip in which there exist overhangs on either side, as shown in FIG. 2. These overhangs extend along the axial direction both towards and away from the mandrel head 23 and enable forming a lap joint between wraps as shown in FIG. 3.

In a second embodiment the tour corner posts 22*a*, 22*b*, 22*c*, and 22*d* are located on X-Y (cartesian) linear motion position controlled axes. These posts' positions would be moved to form the corners of a rectangle that is formed by changing their relative X-Y positions by moving linear motion axes mounted to the faceplate 24.

The supporting structure also contains a feeder structure 3 that is on a position-controlled yaw axis 5 that is computer angle-controlled with respect to the rotation axis of the mandrel in order to form the wrap angle of the structure. The feeder holds three rolls of paper 4*c*, 4*b*, and 4*a* where paper from the first roll 4*c* forms the outer layer, the paper 4*b*' from the second roll 4*b* passes through a corrugator 14*b* to form corrugated paper 4*b*" and the paper 4*a*' from the third roll 4*a* forms the inner layer, where adhesive is applied to the underside of the first layer 4*c*' from applicator 6*b* and the topside of the third layer 4*a*' by applicator 6*a* and all three layers of paper come together at a gathering head (e.g., between rollers 44) to form a laminate 7 where successive wraps are then bonded by the action of wrapping over the mandrel's corner posts. The layers are brought together with an offset as shown in FIG. 1*b* and to form different size packages the positions of the corners of the mandrel are computer controlled and they have at their outer corners conveyor devices to axially move the package structure as it is forming by being spirally wound towards the end of the mandrel; and then the package end is slit or scored mechanically or with a laser as it moves along or comes off the mandrel so the ends can be folded over to close the ends of the package.

Figure 4:
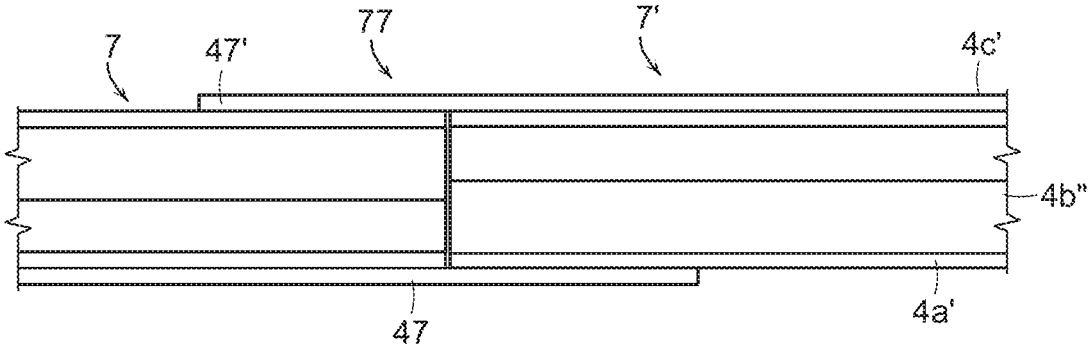
FIG. 4 shows the lap joint of FIG. 3 in detail.

As the three strips 4*a*', 4*b*", and 4*c*' are brought together between the rollers 44 and wrap onto the mandrel posts at an angle as the mandrel rotates, they are offset such that the top sheet 4*c*' overhangs the corrugated sheet 4*b*" to the left as shown in FIGS. 2-4, and the bottom sheet 4*a*' overhangs the corrugated sheet 4*b*" to the right as shown in FIGS. 2-4. This means that for the rolls of material 4*c*, 4*b*, and 4*a*, the roll 4*b* is narrower than the roll 4*c* and the roll 4*a* by the overhang amount. As shown in FIGS. 3 and 4, the overhang allows subsequent wraps to overlap and form the double-sided lap joint with the adhesive previously applied.

In another embodiment, adhesive would not be applied, rather an adhesive backed tape, such as gaffer's tape, which is easy to peel, could be used for the first and third rolls of material, where the adhesive on one side of the material on the first and third rolls is used to bond the fluted center to the outer layers and then the exposed overhanging portions 47' and 47 that are used to form the lap joint as shown in FIG. 3 can adhere to the corresponding surfaces (e.g., 47 with its adhesive on the inside adheres to the outside of layer 4*a*'). Stronger adhesives and plant-based recyclable adhesives can also be used for the tape. For extremely strong and water-resistant boxes, fiber-reinforced paper (tape) could be used. Even clear plastic tape could be used and in place of the corrugated material, a clear bubble wrap used, so contents placed inside the package could be protected and still visible. The advantage of using tape is that a machine that does not need an adhesive applicator would operate more cleanly and be less likely to have reliability issues. Note the adhesive backed tape could also be heated at the point of wrapping so as to make the strip more pliable.

FIG. 3 shows a small portion of adjacent first and second windings 7 while FIG. 4 shows a cross section of the portion in FIG. 3 along the translation axis. Between the first winding 7 and the second strip 7' is thus formed a double-sided lap joint 77. An application of adhesive on the overhanging surfaces creates a durable bond between adjacent windings 7, 7'. In an alternative embodiment, tape (e.g., gaffer's tape) bonds the adjacent windings 7, 7'. Other embodiments use fiber-reinforced tape to bond adjacent windings 7, 7'. This is particularly useful where strong packages with some water-resistance are desired. Yet other embodiments rely on clear tape. A particularly useful embodiment is one in which the second roll 4*b* stores bubble wrap precursor sheet, which is inflated by an inflater that takes the place of the corrugator to form the sealed bubble chambers as it comes off the roll, instead of the second paper 4*b'*.

Once the number of windings 7 is sufficient, the winding process completes. This results in a rectangular tube having a proximal section, a distal section, and a central section between the proximal and distal sections. The length of the central section is equal to the desired depth of the package. The proximal and distal sections will be used as flaps to close off the proximal and distal ends of the package. Because the windings 7 define a spiral, the proximal and distal sections do not have a well-defined length.

A distal section features four sides that meet and form four edges. To permit the distal section to fold, it is necessary to convert these four sides into four end flaps on each end of the box. This is carried out by manipulating the substrate in the vicinity of the edges so that the four sides will fold along a preferred folding line.

Figure 5:
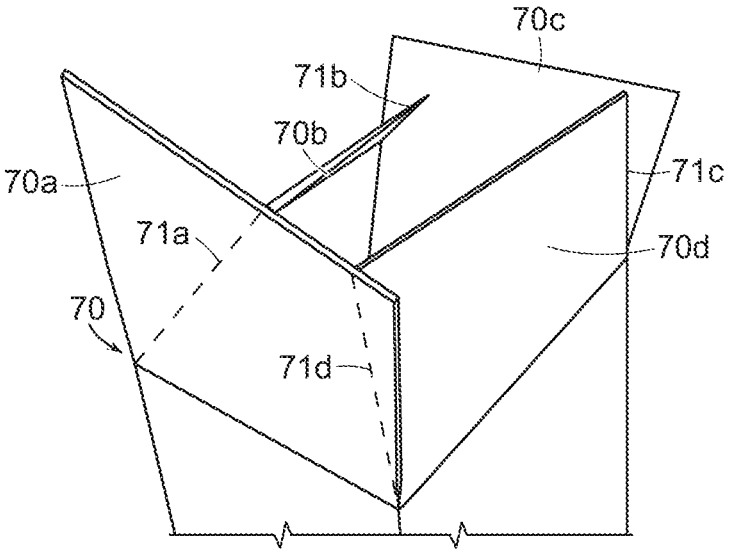
FIGS. 5 and 6 show an end of a package formed by the package-forming machine of FIG. 1 with slits to allow the ends to fold over with the end flaps open and partially folded closed.

FIG. 5 shows a distal section of a package 70 in which first, second, third, and fourth sides of the distal section have been converted into corresponding first, second, third, and fourth flaps 70*a*, 70*b*, 70*c*, 70*d* by cutting corresponding first, second, third, and fourth slits 71*a*, 71*b*, 71*c*, 71*d* along the translation direction at each edge along which two sides intersect. As shown in FIG. 5, the first, second, third, and fourth flaps 70*a*, 70*b*, 70*c*, 70*d* have distal edges that define four lines.

The first and third flaps 70*a*, 70*c* fold around parallel first and third folding axes on opposite sides of the package. These two flaps 70*a*, 70*c* are along the rectangle's length. As such, they define a long pair. Similarly, the second and fourth flaps 70*b*, 70*d* fold around parallel second and fourth folding axes on opposite sides of the package. These two flaps are along the rectangle's width. As such, they define a short pair. The process of closing of the package includes two folding steps: folding the flaps 70*b*, 70*d* in the short pair followed by folding the flaps 70*a*, 70*c* in the long pair over the short pair.

Figure 6:
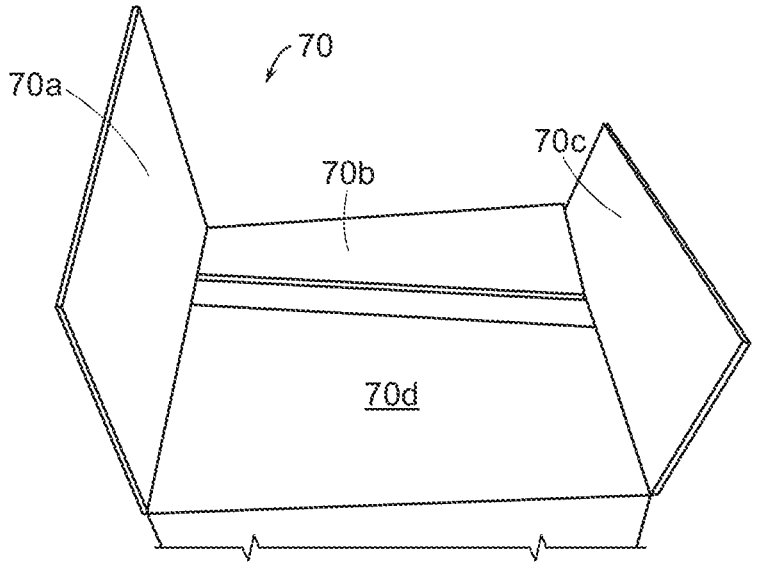

FIG. 6 shows the distal section after completion of the first folding step. The angle of the wrap can be plainly seen. It is apparent here that for this size box that a gap exists between the two flaps 70*b*, 70*d* of the short pair and that this gap extends across the package's width. It is also apparent that the length of this gap is longer than the package's width. The extent to which the gap's length exceeds the package's width depends on the wrap angle, which in turn is controlled by swiveling the feed 3. Indeed, this gap will change depending on the size of the box, but is indicative of the fact that the final folding over of flaps 70*a* and 70*c* are to be on the long side of the box which as shown in FIG. 2*c* where they are fully folded over, they yield a closed diagonal seam, indicated by dashed line 72 on the bottom of the box which is then taped over. That the angled ends of the open box can close to form a tightly sealed end, albeit with a diagonal seam, is an unexpected result that means the material that forms the box can be almost entirely used, or as discussed below in accordance with FIG. 15, entirely used.

Figure 7:
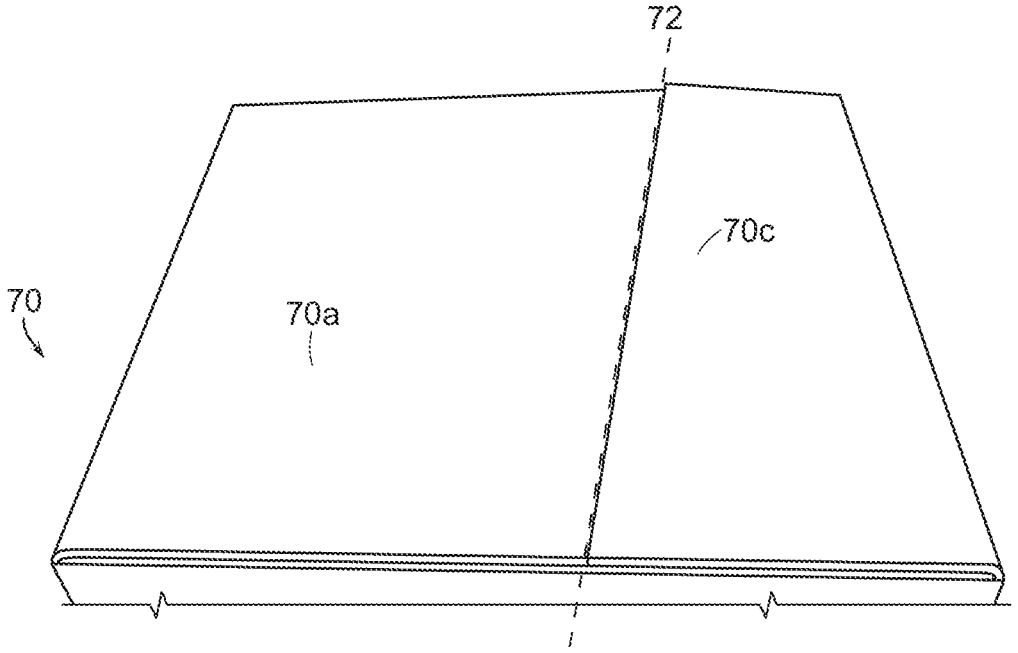
FIG. 7 shows the package from FIGS. 5 and 6 with the end having been folded over and taped shut.

FIG. 7 shows the distal section after completion of the second folding step. It is apparent that there exists a diagonal seam 72 that is longer than the length of the rectangle. The extent to which the seam's length exceeds the package's length depends on the wrap angle, which in turn is controlled by swiveling the feed 3 in response to the width of the strip used to form the box. This seam 72 is then taped over to seal the end of the package.

Of particular interest is the observation that the short pair, when folded, results in a gap whereas the long pair, when folded results in a seam 72. This means that the package can be sealed with no angled cuts to the strip and hence no waste. This is something that no other box making machine can accomplish and is of significant advantage, because managing waste, no matter how minimal, is very difficult in a high-volume production environment.

Figure 8:
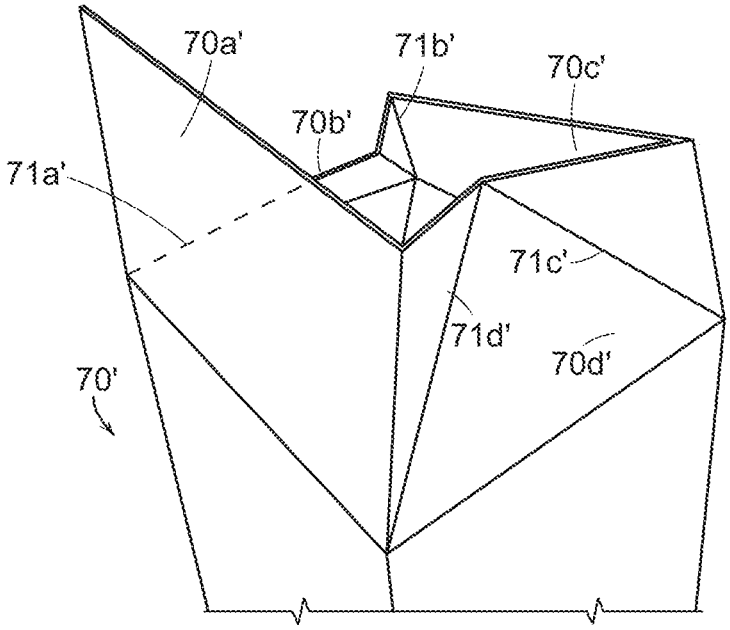
FIGS. 8 and 9 show a package formed by the package-forming machine of FIG. 1 in which scores at forty-five-degree angles have been formed to allow the ends to be folded over.
Figure 9:
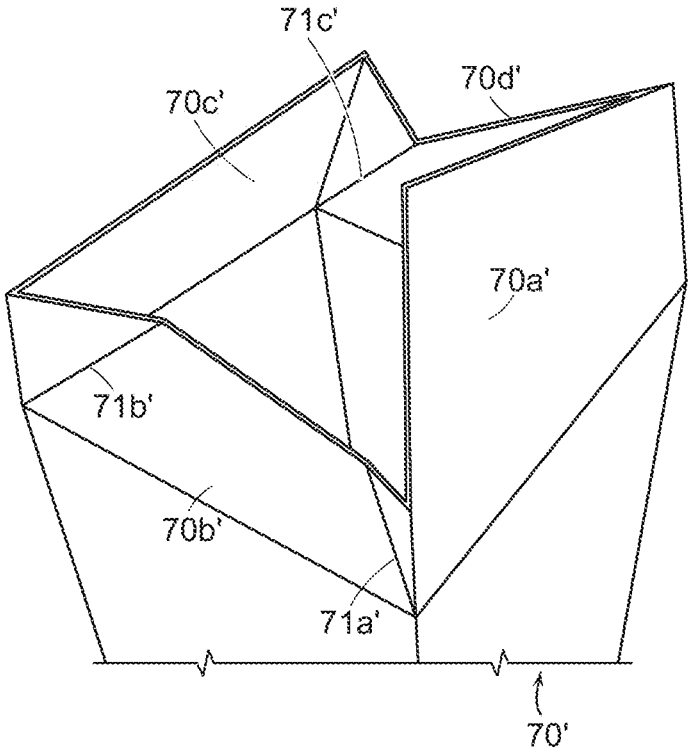
Figure 10:
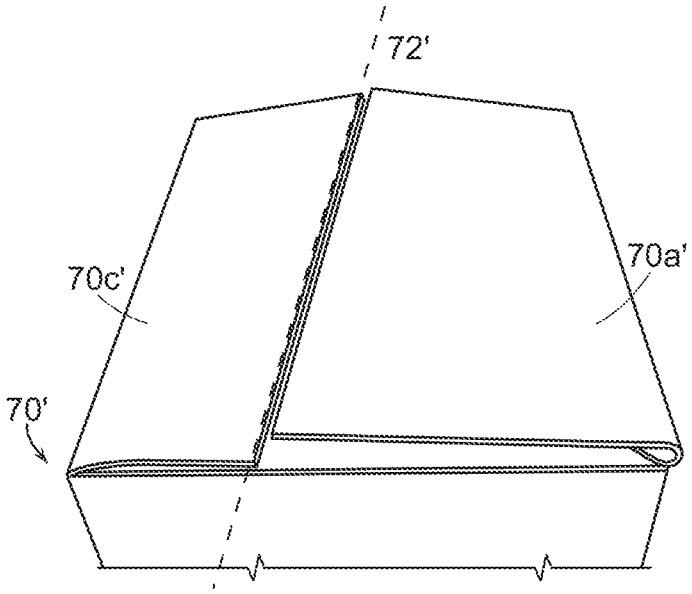
FIG. 10 shows the package of FIGS. 8 and 9 with the end having been folded over and taped shut.

FIGS. 8-10 show the same principle in connection with a distal end in which the slits 71*a*, 71*b*, 71*c*, 71*d* of FIGS. 5-7 have been replaced by score lines 71*a'*, 71*b'*, 71*c'*, 71*d'*. Here box 70' where scores 71*a'*, 71*b'*, 71*c'*, and 71*d'* have been formed at the corners to allow the end flaps 70*a'*, 70*b'*, 70*c'*, and 70*d'* to fold over. The end flaps 70*b'* and 70*d'* are first folded inwards in the same way that when a Christmas present in a box is wrapped and the wrapping paper forms a tube that overhangs the box, diagonal creases (here scores) are formed, that as they continue to be bent inwards, the flaps 70*a'* and 70*c'* remain planar and start tilting as they fold inwards. As before there will be a gap between the edges of sides 70*b'* and 70*d'* depending on the size of the box, but is indicative of the fact that the final folding over of flaps 70*a'* and 70*c'* are again to be on the long side of the box which as shown in FIG. 3*c* where they are fully folded over, they once again yield a diagonal seam, indicated by dashed line 72' on the bottom of the box which is then taped over. Once again this is an unexpected result that means the material that forms the box can be almost entirely used, or as discussed below in accordance with FIG. 15, entirely used.

FIGS. 11-14 show a computer model with details of a box that can be formed, where there are 7 side panels created by 1.75 rotations of the mandrel, and the footprint of the box is 7"×6" to achieve the closing properties illustrated in FIGS. 5-10 for a particular case in which the package has a length of seven inches and width of six inches is made using a five inch wide strip in which the fluting 4*b*" is 4.5 inches wide, resulting in a half inch overlap between strips. The depth of the finished package in the illustrated example will come to 3.224 inches. Also shown are the representative dimensions of the features along the edges for the 6"×7" box.

Figure 11:
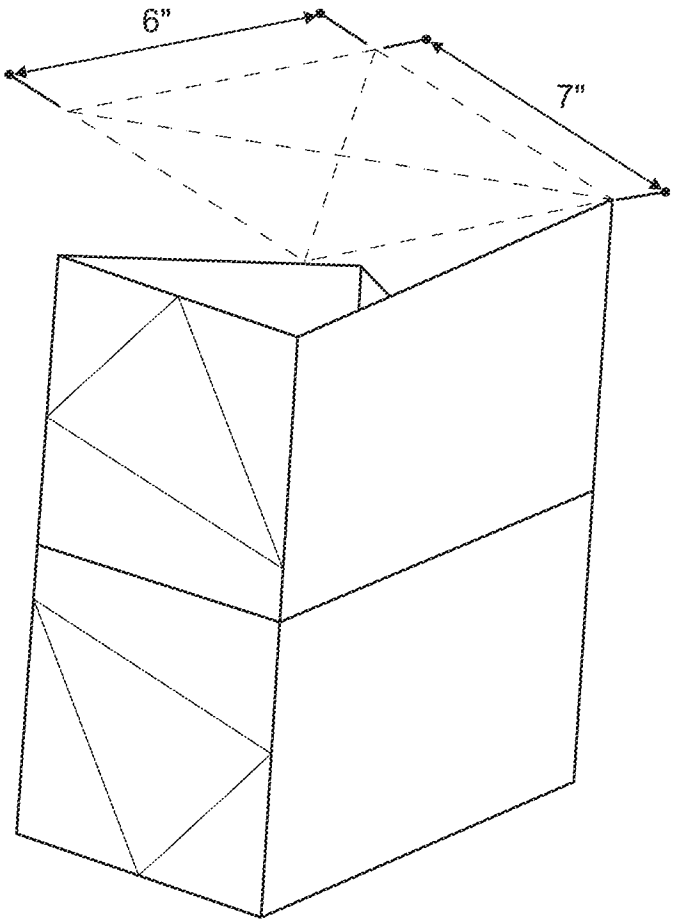
FIG. 11 shows a computer model of a package having seven side panels that can be formed by 1.75 rotations of the mandrel of the package-forming machine of FIG. 1. Where lines indicate triangles and quadrilaterals defined by scoring that will enable folding the end panels to close the box.

Each quarter turn of the mandrel 10 lays down one a section of strip used for one side panel of the package. FIG. 11 shows the package after seven such quarter turns so that seven side panels have been formed. The five-inch strip can be seen in FIG. 4B after having been lain down with a wrap angle of 12.02 degrees. The vertical projection of the strip is therefore the product of the strip's width and the secant of the wrap angle, which in this case is 5.112 inches.

Figure 12:
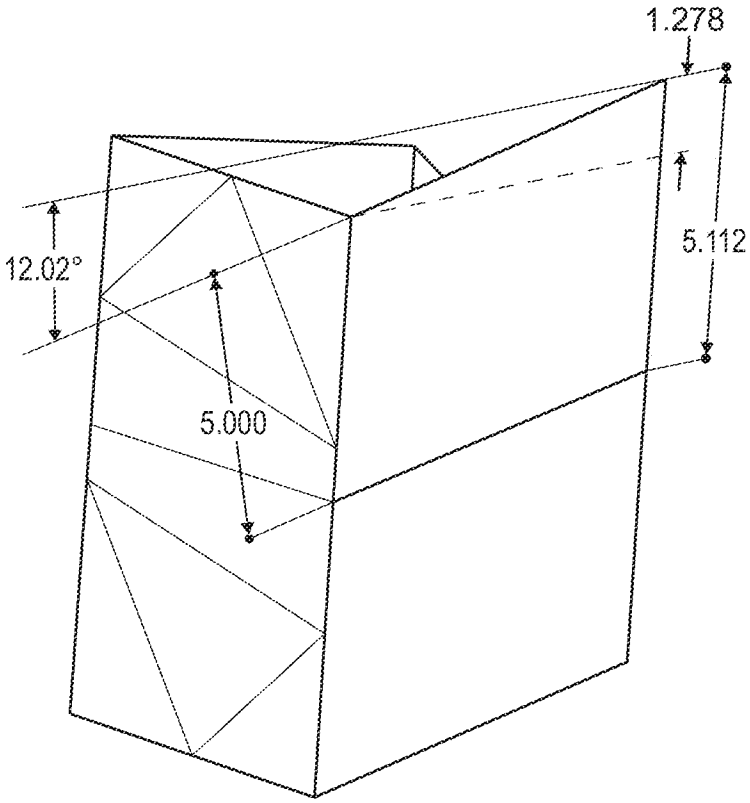
FIG. 12 shows the dimensions of the first panel of the package in FIG. 11 as it would be wrapped.
Figure 14:
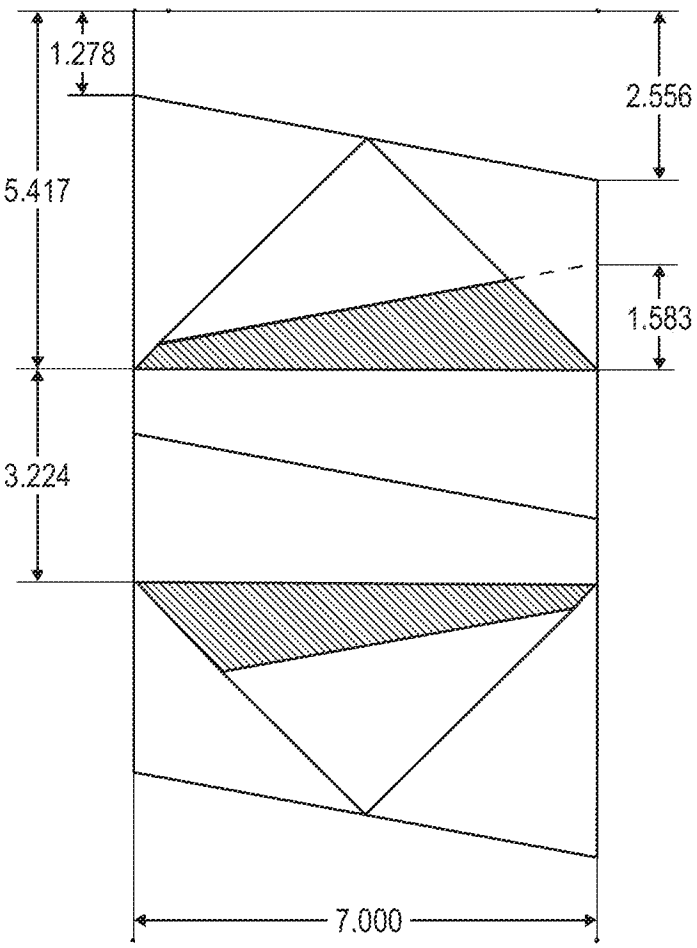
Figure 13:
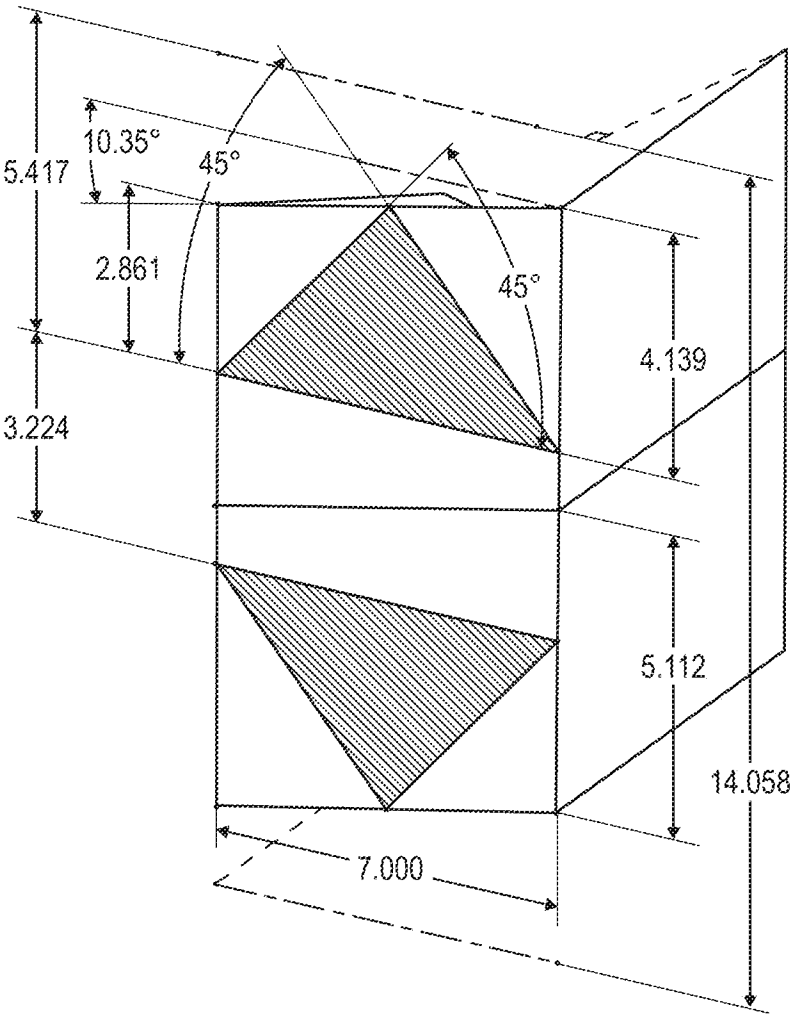

FIGS. 13 and 14 shows where score lines are placed on two sides of the package for the configuration shown in FIGS. 11-12 to correctly close the end flaps.

In the case of a rectangular helix, to assure a constant overlap to reliably form the lap joint 77 in FIGS. 3 and 4 as the strip makes its way around the different posts 22*a*, 22*b*, 22*c*, 22*d*, it is useful to axially shift the strip by a quarter of the winding's vertical projection, which in this example is 5.112 inches. This will ensure that four quarter-turns of the mandrel 10 will shift the strip by the extent of the winding's vertical (axial) projection.

For a given configuration, there exists an angular shift rate, which is the derivative of the extent that windings 7 shift along the translation axis as a function of the angular position of the mandrel 10. Ideally, angular shift rate should be constant. This will ensure that the extent of the shift remains the same as the strip proceeds one post 22*a*, 22*b*, 22*c*, 22*d* to the next 22*b*, 22*c*, 22*d*, 22*a*. Thus, upon reaching the second post 22*b*, the strip should have shifted by 25% of the vertical projection; upon reaching the third post 22*c*, the strip should have shifted by 50% of the vertical projection; and upon reaching the fourth post 22*d*, the strip should have shifted by 75% of the vertical projection so that by the time the first post 22*a* comes around again, the shift by one vertical projection will have been completed.

However, as a result of having a rectangular (not square) footprint, the distances between the posts 22*b*, 22*c*, 22*d*, 22*a* are not all the same. Therefore, to achieve a constant angular shift rate, it is useful to vary the wrap angle as the different posts 22*b*, 22*c*, 22*d*, 22*a* go by the gathering head 44. It is for this reason, that a controller causes the feeder 3 to rotate about a vertical yaw axis Y perpendicular to the longitudinal (translation)axis of the box (and mandrel). In the particular examples described herein, the controller yaws the feeder 3 between a 12.02-degree angle when laying the strip down on the short side and 10.35-degree angle when laying the strip down on the long side. The box is thus effectively wound in a segmented spiral-like manner (a sequence of angled straight lines around a longitudinal axis).

In the illustrated example, the net height of the package is 3.224 inches. In this case, this is also equal to the box-depth growth increment for the illustrated geometry. In general, the growth increment will depend on the strip's width and how many times the mandrel 10 rotates. For a package with a small footprint, the growth increment is large, which means that the package's depth cannot be adjusted with high resolution. In such cases, where the footprint of the package is comparable to the strip's width, the growth increment will be on the order of a quarter of the strip's width. Thus, to finely control the package's depth, it is desirable to use narrow strips. In cases where the footprint is larger, it is easier to adjust the package's depth with finer resolution without running the risk of the first end flap 70*a* being too long.

FIG. 15 shows the box of FIG. 10 where the very beginning and the very end of the material wound to form the box 70 have been cut perpendicular to the length of material. This leaves small triangles 170*a* and 170*b* of material hanging over the sides of the box prior to folding the ends to close the box. This material can become part of the end flap fold, thereby totally eliminating waste so the machine does not have to deal with waste that would occur if the end had to be cut at an angle because the next box might be a different size and require a different angle cut. This triangle of material thus becomes part of the box, increasing its strength and packing resilience. While these small triangles have the advantage of totally eliminating waste and providing some added measure of strength, they will require a small slit 170*s* in the edge of the side that makes the first wrap at this corner. This means that a substrate cutter at the exit of the gathering head 44 would cut the substrate's end perpendicular to the long axis of the material to ensure no waste. This also greatly simplifies the machine design and operation.

As shown in FIG. 15, the total length of the strip of material of width w to form the box 70 is L' which is shown by the dashed line which as is traced around the box has seven segments. L is the top edge length shown (four free edge segments, none of which are parallel to a cross section plane orthogonal to the longitudinal (translation)axis of the box), which it will be noted none. The perimeter P of the box 70 of height c when ends are folded shut as a function of its dimensions a and b is:

$$P=2*(a+b)$$

For a square box, the following analysis applies.

The helix angle θ (which is then the angle between each top edge and the cross-section plane, is given by $$\theta=\sin^{-1}(w/P)$$

The diagonal width of the strip, w' is aligned with the vertical edge of the box and is given by:

$$w'=w/\cos(\theta)$$

The top-edge length L of a square box is given by:

$$L=P/\cos(\theta)$$

Using trigonometric identities, it can be shown thus that:

$$L=P^2/\mathrm{sqrt}(P^2-w^2)$$

The total length of the strip needed to form a box is the product of L and the number of wraps, which need not be an integer.

Given the width w of the strip of material used to form the box, and the dimension h of the box such that the ends will fold closed with the flaps meeting along a line (which can be an angled closure line as shown in FIG. 10), the achievable height c of a square-footprint box is found from FIG. 15 by:

$$c=3*w'/4$$

$$5*w'/4=b$$

$$w'=4*b/5$$

$$c=12*b/5$$

For a box having a rectangular footprint, the angle θ will change with the relative side length according to the constraints:

$$w'=w/\cos(\theta_1)$$

$$w'=2(a*\tan(\theta_2)+b*\tan(\theta_1))$$

$$\theta_1/\theta_2=a/h$$

The above constraints lead to 45-degree fold lines for the end panels (e.g., FIG. 13) that meet in the middle of the edge, which is also an important result.

The above analysis is focused on the case where a minimum-size box is made from a maximally-wide strip of material. Of course these equations can be manipulated to select the desired dependent and independent variables. When a strip is narrow in relation to the box dimensions, the end of the strip is still kept perpendicular (square cut) to the length of the strip and the end folds still form in a similar manner with the folded flaps forming an angled seam across the ends of the box. Once again, there is literally zero waste that needs to be generated and clean closed ends of the box are achieved, just with the unique angled seam made possible by the present invention.

Figure 16:
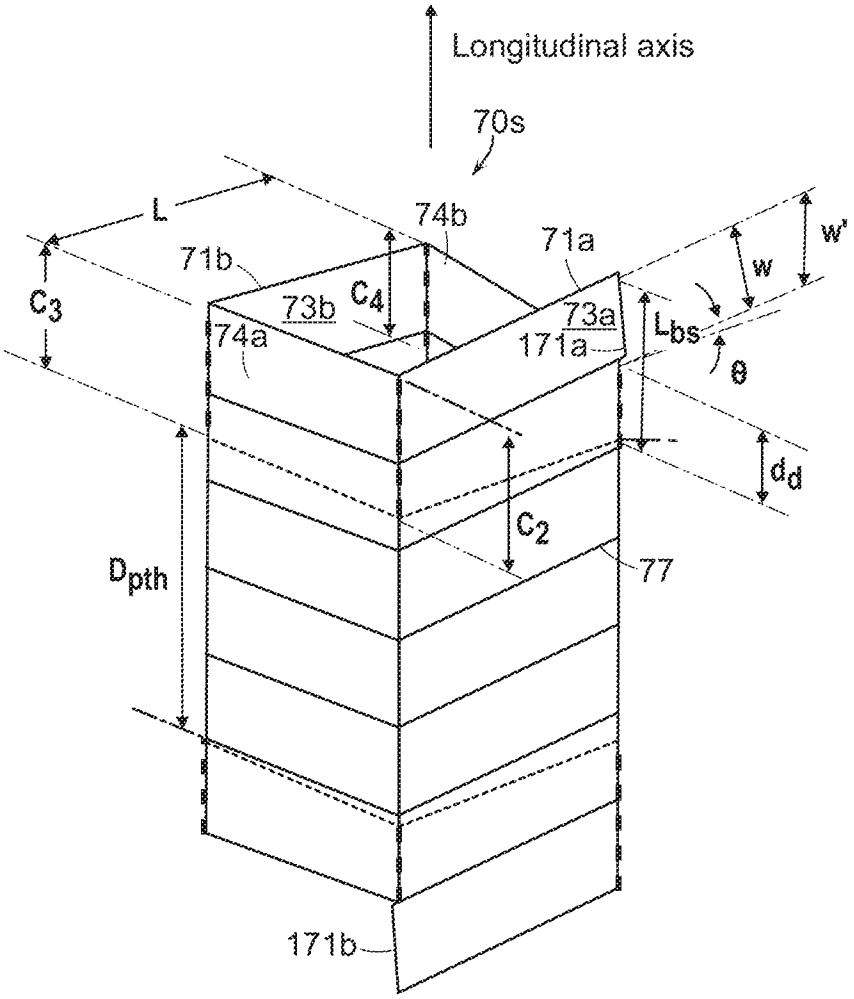
FIG. 16 shows a square footprint box with ends open, with labeled significant parameters, made from many wraps of strip.

FIG. 16 shows a square footprint box 70S, with labeled significant parameters, made from many wraps of strip of width w, with a width along the longitudinal axis of the box of w' as before described. Flaps 74*a* and 74*b* will fold down and then be covered by end forming flaps 73*a* and 73*b* that form a diagonal seam across the end with edges 71*a* and 71*b*.

Figure 18:
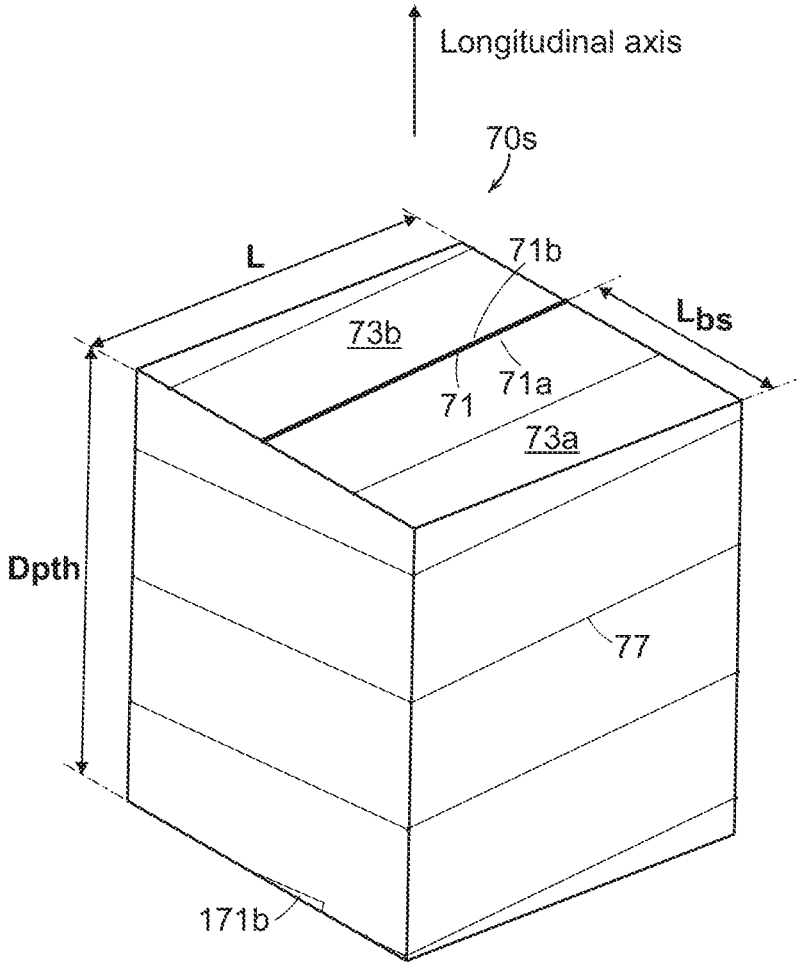
FIG. 18 shows the square footprint box of FIG. 16 with the ends folded closed to form the angled (with respect to the sides of the box) edge-to-edge closure line of the folded closed end flaps.

FIG. 17 shows cells from a spreadsheet and the formulas for helping to design the box 70S and control its manufacture in the package maker machine. Here the size of the box is $L \times L \times D_{pth}$. Being a square box, the wrap angle θ is the same for each corner. Note the dimension "L" corresponds to the dimension "a" previously discussed. FIG. 18 shows the box 70S with end flaps closed where the edge 71*a* of flap 73*a* meets edge 71*b* of flap 73*b* meet to form the angled top seam 71 (across which then for example a strip of tape would be placed to seal the end). The lap joint between strips is indicated for example by 77. The dimension $L_{bs}$ is the total length of the long side of the top flap. This box is constructed by having slits cut in the edges such as indicated by the dotted lines in the corners with dimensions $d_d$, $C_1$, $C_2$, $C_3$.

Similar analysis is done for a non-square footprint box, and the end flaps will also close forming a diagonal seam across the end. The small triangular appearance zones 171*a* and 171*b* are analogous to 170*a* and 170*b* in FIG. 15, and are actually a result of the right angle cut on the strip. These enable there to literally be zero waste in forming the box, and they would fold over the sides of the box at final closure.

For an embodiment that is made just to create bags, the system can be greatly simplified where there are only two posts on the mandrel where the distance between posts is controlled. This mechanism will not require two degree of freedom control of each post the way a box winder does, and now a simple rack and pinion system can be used for example to control the distance between the posts. The same material-forming and method is used for bags as described previously for boxes, but the ends of the bag have two sides, not four, and slitting is not needed, only folding over the end features to form end flaps that fold over onto the middle section to close the bag's ends.

As with the box, the proximal and distal sections' free edges are each not parallel to the cross section and thus when the ends are folded over, they will form a seam with the bag that is not perpendicular to the longitudinal axis of the bag. This means there is no waste generated and the extra bag thickness in the region of the folded-over ends increases padding for the product shipped inside the bag.

In some cases depending on the strip size this will result in two layers of material being folded over, but in the case of a bag made with integral bubbles, this just results in extra padding at the end of the bag. Alternatively, the bag can be heat-sealed along a diagonal (ends of bag are not square) to form a rhombus-like shaped bag, or if waste is tolerated, the bag can be heat-sealed square at the ends and cut off from the infeed strip. This will leave an angled end on the strip that would need to be trimmed for making the next bag be the same as the previous.

The bag formed by this embodiment would have a length along the mandrel's posts' longitudinal axis and a slim rectangular cross section that lies in a plane that is orthogonal to the longitudinal axis, where the cross section has a defined width by the spacing between the posts and the post diameter and a thickness of twice the bag material when the bag is pressed flat.

The invention claimed is:

1. A computer-controlled apparatus for forming a box made from a substrate strip that is angularly wrapped about an axis, comprising, said box to be formed having a depth along a translation axis of wrapping and a cross section that lies in a plane that is orthogonal to said translation axis, wherein said cross section is a rectangle having a length and a width, said box to be formed comprising a proximal section, a distal section, and a middle section between said proximal and distal sections, said proximal and distal sections being inwardly foldable to form end flaps that come together with an angled seam with respect to the sides of the middle section to close corresponding proximal and distal ends of the box, wherein said proximal and distal sections' four free edges are each not parallel to said plane orthogonal to said translation axis, said apparatus comprising a feeder, a winder, a linear-motion mechanism, and a substrate cutter, wherein said winder comprises a mandrel and posts that extend from said mandrel in a direction along said translation axis, said posts being controllably separated from each other by computer-controlled dimensions, wherein said mandrel and said posts rotate together as a unit around said translation axis, wherein said feeder comprises material-roll handlers, a gathering head, and a yaw-angle-control motor, wherein said material-roll handlers receive rolls of precursors for layers of said substrate strip, wherein said gathering head participates in forming said precursors into a substrate strip and feeding said substrate strip to said winder, wherein said yaw-angle-control motor is configured to adjust an angle of said feeder on said winder and the linear-motion mechanism provides relative linear motion between the box being formed and the feeder in response to instructions from a computer so as to cause a controlled overlap between adjacent windings of said substrate strip on said posts as the box is formed, and wherein the substrate cutter cuts the substrate to separate the box from the substrate.

2. The apparatus of claim 1, wherein said feeder further comprises a flute maker to form fluting, said fluting forming a fluted layer in said substrate.

3. The apparatus of claim 2, wherein said feeder further comprises first, second, and third material-roll handlers, said second material-roll handler being disposed between said first material-roll handler and said third material-roll handler, wherein said flute maker receives material from said second material-roll handler and forms said material into a fluted low-density layer that is disposed between and bonded to material from said first material-roll handler and material from said third material-roll handler.

4. The apparatus of claim 2, wherein said fluted layer comprises a honeycomb layer in said substrate.

5. The apparatus of claim 1, wherein said linear-motion mechanism comprises a conveyor disposed on a corresponding one of said posts, said conveyer having outward facing gripping protrusions.

6. The apparatus of claim 1, wherein said precursors comprise plastic film that is to be heat bonded.

7. The apparatus of claim 1, wherein said precursors comprise a precursor that comprises material that has been pre-coated with an adhesive.

8. The apparatus of claim 1, wherein said precursors form corresponding layers of said substrate, wherein said feeder further comprises an adhesive applicator configured to apply adhesive to portions of at least some portion of said layers.

9. The apparatus of claim 1, wherein said precursors comprise strips each of a width such that, when formed into said substrate strip, result in said substrate strip comprising an overhanging flap along a longitudinal edge thereof, wherein as a result of said overhanging flap, said controlled overlap between adjacent windings of said substrate strip results in a lap joint that joins said adjacent windings.

10. The apparatus of claim 1, further comprising a slitter that is configured to form slits in said distal and proximal sections, said slits extending longitudinally along corners of said box to be formed along said translation direction to form said angled-seam end-flaps.

11. The apparatus of claim 10, wherein the slitter comprises a laser.

12. The apparatus of claim 1, further comprising a scorer that is configured to score said distal and proximal sections so as to promote folding of said distal section into angled-seam end-flaps.

13. The apparatus of claim 12, where in the scorer comprises a laser.

14. The apparatus of claim 1, wherein said substrate cutter cuts the substrate ends perpendicular to a long axis of the substrate strip.

15. The apparatus of claim 1, wherein said mandrel comprises a head and arms along the longitudinal axis, wherein said posts connect and project outward from said arms in a direction along said translation axis, and wherein said arms have a relative angularly-adjustable position, and wherein said posts have an linear-adjustable position along said arms.

16. The apparatus of claim 1, further comprising a conveyor that causes relative translation between said box being wrapped on said posts and said gathering head.

17. The apparatus of claim 1, wherein said material-roll handlers comprises spools, each of which holds material to be used for forming a layer of said substrate.

18. The apparatus of claim 17, wherein the material on the spools for forming inner or outer layers is adhesive-backed.

19. The apparatus of claim 1, wherein said posts are removable from the winder, and the winder is configured to retain 2, 3, 4, 5, or 6 posts.

20. The apparatus of claim 1, wherein the material-roll handlers comprise a first material-roll handler and a second material-roll handler.

21. The apparatus of claim 20, wherein the feeder further comprises an adhesive application configured to apply adhesive to bond together material from the first material-roll handler and the second material-roll handler.

22. The apparatus of claim 21, where the adhesive has lower density than the material from either the first material-roll handler or the second material-roll handler.

23. The apparatus of claim 1, wherein the apparatus is configured to form a box wound from a substrate strip, said box extending along a longitudinal axis and comprising a proximal section, a distal section, and a middle section between said proximal and distal sections, said proximal and distal sections being inwardly foldable to form end flaps that come together with a seam angled with respect to the sides of the middle section to close corresponding proximal and distal ends of the container, wherein said proximal and distal sections' free edges before being folded over are each not parallel to a plane that is orthogonal to said longitudinal axis.

24. The apparatus of claim 23, wherein said angled seam is a diagonal seam.

25. The apparatus of claim 23, wherein said substrate strip comprises corrugated material.

26. The apparatus of claim 23, wherein said substrate strip comprises bubble wrap.

27. The apparatus of claim 23, wherein said container has a first mass, wherein said substrate strip that is used to make said container has a second mass, and wherein said first mass is equals or greater than said second mass.

28. The apparatus of claim 1, wherein said feeder further comprises material-roll handlers and a bonder to bond an inner layer and an outer layer of material from the material roll handlers with a low-density layer therebetween.

29. The apparatus of claim 28, wherein the material-roll handlers comprise first and second material-roll handlers, and the apparatus further comprises a bubble wrap inflator, wherein said first material roll is if for an outer layer and said second material roll is for a bubble-wrap precursor material, wherein said bubble wrap inflator receives material from said second material-roll handler and forms said bubble wrap with an inner layer to be bonded to material from said first material roll handler.

30. The apparatus of claim 1, wherein said substrate end fed into said winder is cut perpendicular to a long axis of the substrate strip.

* * * * *